US005983772A

United States Patent [19]

Reynolds et al.

[11] Patent Number: 5,983,772

[45] Date of Patent: Nov. 16, 1999

[54] SUBCALIBER DEVICE/BLANK FIRING ADAPTOR FOR BLOWBACK OR RECOIL OPERATED WEAPONS

[76] Inventors: George L. Reynolds; S. Paul Reynolds, both of 2978 Knox Hwy. 3, Altona, Ill. 61414; John M. Miller, Rt 3 Winters Dr., Marietta, Ohio 45750

[21] Appl. No.: 08/924,054

[22] Filed: Aug. 28, 1997

[51] Int. Cl.[6] ..... F41A 21/10

[52] U.S. Cl. ..... 89/29; 42/77; 89/30; 89/14.5

[58] Field of Search ..... 89/29, 30, 14.5; 42/77; 102/530

[56] References Cited

U.S. PATENT DOCUMENTS

| | | | |
|---|---|---|---|
| 353,231 | 11/1886 | Morris | 42/77 |
| 533,171 | 1/1895 | Hurst . | |
| 1,217,162 | 2/1917 | Egbers | 42/77 |
| 2,898,693 | 8/1959 | Ruger | 42/77 |
| 3,363,509 | 1/1968 | Tschoepe | 89/14 |
| 3,411,229 | 11/1968 | Gronemann | 42/77 |
| 3,744,370 | 7/1973 | Snodgrass | 89/14.5 |
| 5,377,438 | 1/1995 | Sheinfeld et al. | 42/96 |
| 5,438,907 | 8/1995 | Reynolds et al. | 89/14.5 |
| 5,492,063 | 2/1996 | Dittrich | 102/430 |

FOREIGN PATENT DOCUMENTS

| | | | |
|---|---|---|---|
| 340829 | 11/1989 | European Pat. Off. | 89/14.5 |
| 662545 | 8/1929 | France | 42/77 |
| 1496220 | 9/1967 | France . | |
| 730030 | 1/1943 | Germany | 42/77 |
| 1195205 | 6/1965 | Germany . | |
| 8102 | 2/1894 | United Kingdom | 89/29 |
| 874 | 2/1907 | United Kingdom | 42/77 |

*Primary Examiner*—Stephen M. Johnson
*Attorney, Agent, or Firm*—Woodard, Emhardt, Naughton Moriarty & McNett

[57] ABSTRACT

The bolt of a blowback operated weapon is driven rearward by multiplying the area acted upon by pressurized gas generated by a subcaliber bulleted cartridge or a blank cartridge fired in a subcaliber barrel inserted into the weapon barrel and attached to the weapon barrel muzzle.

11 Claims, 3 Drawing Sheets

SUBCALIBER DEVICE/BLANK FIRING ADAPTOR FOR BLOWBACK OR RECOIL OPERATED WEAPONS

BACKGROUND OF THE INVENTION

This invention is related to BLANK FIRING ADAPTOR, U.S. Pat. No. 5,438,907 by George Reynolds and John Miller, but is equipped with a subcaliber barrel instead of a spigot, employs gas pressure multiplier system and fires bulleted cartridges or blanks.

Medium caliber automatic weapons such as the Mk19, 40 mm machinegun used by U.S. military forces require relatively expensive training ammunition because of the relatively large size of the ammunition used plus the fact that the Mk 19 is a machinegun. It is estimated there are 300,000 Mk 19's in active use in the U.S. military services. It is conservatively estimated that each gun is fired 100,000 rounds in training during the life of the weapon. Conventional training rounds cost approximately $15 each, resulting in a life cycle training cost for ammunition of $450 billion. Thus, the cost of adequate training is very high for this very effective weapon. Subcaliber devices which provide realistic training are well known for use in most small arms weapons, but until the present, none have been suitable for use with the Mk19 and similar weapons.

SUMMARY OF PRESENT INVENTION

The present invention provides for realistic training by firing relatively inexpensive subcaliber cartridges or blanks in reloadable adaptors. With the cost of the subcaliber device/blank firing adaptor at, say $500 each, the cost of the adaptor cases at $5 each and the cost of the subcaliber cartridge or blank cartridge at 25 cents each, the life cycle cost for firing 100,000 subcaliber rounds through 300,000 MK19's is approximately $9.1 billion, as compared with $450 billion dollars with full caliber training rounds. Use of the subcaliber device will result in a 98% cost reduction for training ammunition compared to using the least expensive full caliber training rounds.

The subcaliber device/blank firing adaptor powers a blowback or recoil operated weapon so the weapon will function in normal automatic fire. All loading, firing, safety, and stoppage procedures normally performed by the gun crew are employed when using the subcaliber device/blank firing adaptor.

Firing with the subcaliber device/blank firing adaptor approximates the feel and noise of firing full caliber service ammunition. The trajectory of the subcaliber projectile nearly duplicates that of full caliber service ammunition. This closely matching trajectory is especially valuable when using subcaliber tracer projectiles so the soldier can become very familiar with the characteristics of time of flight and trajectory arc of service rounds while firing inexpensive subcaliber rounds.

The cartridge case adaptor which contains the subcaliber cartridge or blank cartridge is easily and rapidly reloadable by soldiers training in the field. Reloading is accomplished using a simple, hand operated fixture which is not part of this patent. Installation of the subcaliber device/blank firing adaptor requires no special tools and is performed by the gun crew in the field, requiring less than five minutes in the case of the Mk19 machinegun. All subcaliber device/blank adaptor components are low technology, require no exotic materials, and are inexpensive to manufacture. The blank firing adaptor uses standard, commonly issued conventional rifle/machinegun blanks.

In the three subcaliber device embodiments of the invention three different methods are used to multiply the force of the propellant gas above the straight blowback force of the projected area of the base of the projectile. In the blank firing adaptor embodiment, gas is trapped by a vented muzzle disc at the front of the subcaliber barrel to retain pressurized gas to apply sufficient force to operate the weapon.

In the first embodiment, instead of reaction of the propellant gas being only against the projectile, part of the reaction is transmitted from a primary booster area to the weapon frame though a subcaliber barrel inserted through the main gun barrel and anchored to the muzzle of the main gun barrel.

In the second embodiment, in addition to the reaction of the propellant gas against the primary booster area, as in the first embodiment, a secondary chamber with a secondary booster area is provided to trap gas to apply force for a longer period of time. Propellant gas is released from the subcaliber cartridge chamber into the secondary booster chamber when pressure in the subcaliber chamber exceeds the strength of the subcaliber cartridge case wall at the chamber vent, perforating the subcaliber cartridge case wall at the subcaliber chamber vent. In this embodiment, gas escaping into the secondary chamber of the adaptor pressurizes a larger area (e.g. ten to twenty times greater) than the projected bore area of the subcaliber cartridge projectile. Gas is trapped in the secondary booster by the restriction of the gas vent which admitted the highly pressurized gas from the subcaliber chamber, much as gas is trapped in the gas cylinder of a conventional gas operated gun mechanism.

The third embodiment is like the second embodiment except the secondary chamber is vented to the atmosphere to limit the operating force to that of the primary booster area by eliminating force (rather than adding force) from the secondary booster. This embodiment is required when a standard cartridge such as the 7.62 mm NATO is used, but which provides excess power with the Mk 19. It is desirable to use standard 7.62 mm machinegun ammunition due to its low cost and ready availability.

A fourth embodiment permits the subcaliber device to be converted into a blank firing adaptor related to U.S. Pat. No. 5,438,907 by the installation of a vented restrictor disc at the front of the muzzle of the subcaliber barrel. The vented restrictor disc sufficiently contains the blank generated pressurized gas to operate the weapon. Blank cartridges operate at such low pressure when operated with a large free volume, that the cartridge case wall will not perforate at the booster vent to release gas into the secondary booster chamber. The vented restrictor disc is retained by a vented muzzle cap which also serves as a bullet trap in case a bulleted cartridge is accidently fired when normally using blanks. If a rifle grenade launching cartridge, which is much more powerful than a blank, is accidently fired, the higher pressure of the grenade cartridge bursts the vented restrictor disc, preventing the high power of the grenade cartridge from damaging the gun mechanism. The vented restrictor disc is inexpensive and easily replaced.

In the first three embodiments the operating force of the subcaliber cartridge is multiplied above that available through straight blow-back by a factor equal to the ratio of the projected area of the bore of the subcaliber cartridge to the area of the total booster areas affected by the gas. This fully powers the weapon while using a cartridge less than 1/20 the weight and 1/50 the cost of the least expensive training cartridge the weapon was designed for. By adjusting the booster area(s), initial volume, length of power stroke, diameter of perforation, projectile weight and by selecting powder burning rate the subcaliber device and cartridge can be designed to launch a subcaliber projectile at the same velocity (or higher or lower) as the service projectile. Thus the trajectory of the service round can be closely duplicated provide realistic training. Tracer ammunition can be used where range conditions permit, or ball ammunition can be used where dry range conditions prohibit the use of tracers.

The total blowback force is equivalent to the generated by a full caliber service round, but the reaction is primarily against the gun itself through the subcaliber barrel and muzzle cap attached to the muzzle of the weapon barrel instead of reacting only against the projectile as in straight blow-back operation. In the case of the 40 mm Mk19 subcaliber device using a 1.300 inch diameter secondary booster areas and firing a 0.308 diameter subcaliber bullet, the effective total blowback area is approximately 19 times the area of the subcaliber projectile. Thus it is possible to obtain from approximately twenty grains of powder (when firing a 214 grain subcaliber projectile at approximately 790 feet per second muzzle velocity) more than enough power to operate the Mk19 with its approximately 17 pound bolt.

The Mk19 is normally provided with a bag for catching empty cartridge cases. After firing with the subcaliber device/blank firing adaptor, the soldier in the field collects the empty cartridge case adaptors from the catch bag and ejects the expended subcaliber cartridge cases from the cartridge case adaptors. Fresh subcaliber cartridges or blank are inserted into the cartridge case adaptors, and the cartridge links are repositioned on the cartridge case adaptors. The cartridge case adaptors are re-linked into a belt. This process is accomplished using a simple hand operated fixture which is not part of this invention.

The basic principle of operation of the subcaliber device is typical of other subcaliber devices, except a close ballistic match is achieved between the subcaliber projectile and the service projectile while powering the weapon. In straight blow-back operated weapons, subcaliber projectile may be used, as long as its effective sectional density is the same as that of the service projectile (if the subcaliber projectile is to have the same muzzle velocity as the service projectile). This is neglecting shot start, engraving, and friction forces which are considerable, but which are relatively easy to compensate for.

The invention can also be applied to recoiling barrel weapons by anchoring the subcaliber barrel to the weapon frame rather than to the weapon barrel.

DESCRIPTION OF THE ILLUSTRATIVE EMBODIMENTS

Figure 1:
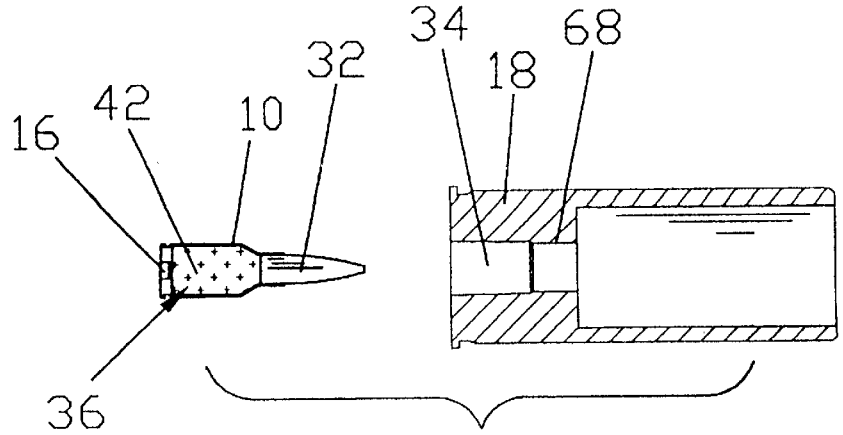
FIG. 1 is a plan view in section of a cartridge case adaptor and a subcaliber cartridge.

Referring to FIG. 1, the outer configuration of a cartridge case adaptor 18 fits the weapon feed system (not shown) and chamber. The cartridge case adaptor 18 is provided with a subcaliber cartridge chamber 34 with an enlarged chamber neck 68. The enlarged chamber neck 68 is significantly larger in diameter than the cartridge case neck of the subcaliber cartridge case 10 of the subcaliber cartridge 36. The subcaliber cartridge chamber 34 of cartridge case adaptor 18 is axially located in the cartridge case adaptor 18 to receive a subcaliber cartridge 36 consisting of a subcaliber projectile 32, a subcaliber cartridge case 10, with propellant 42 and a primer 16. The cartridge case adaptor 18 is reusable.

Figure 2:
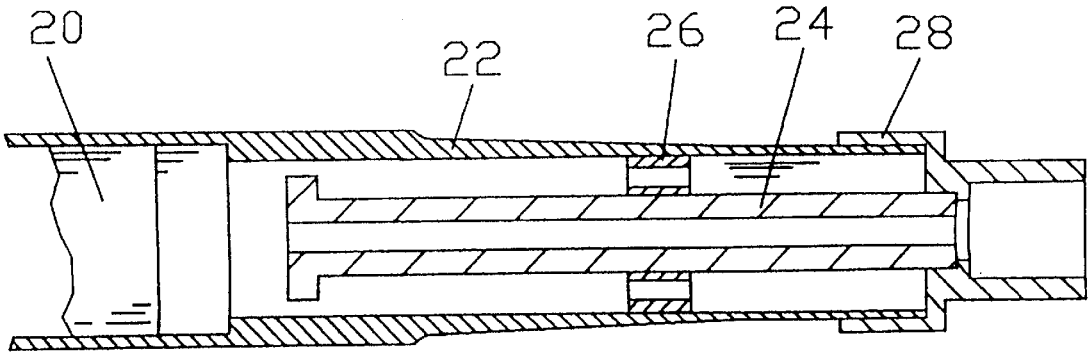
FIG. 2 is a plan view in section of the essential components of the weapon.

Referring to FIG. 2 the flash suppressor of the weapon barrel 22 has been replace with muzzle cap 28. Attached to muzzle cap 28 is a subcaliber barrel 24 with its centering ring 26. The subcaliber barrel 24 is attached to the muzzle cap 28, so that when assembled, the weapon barrel 22, muzzle cap 28 and subcaliber barrel 24 do not move relative to each other. The centering ring 26 centers the subcaliber barrel 24 on the axis of the weapon barrel 22.

Figure 3:
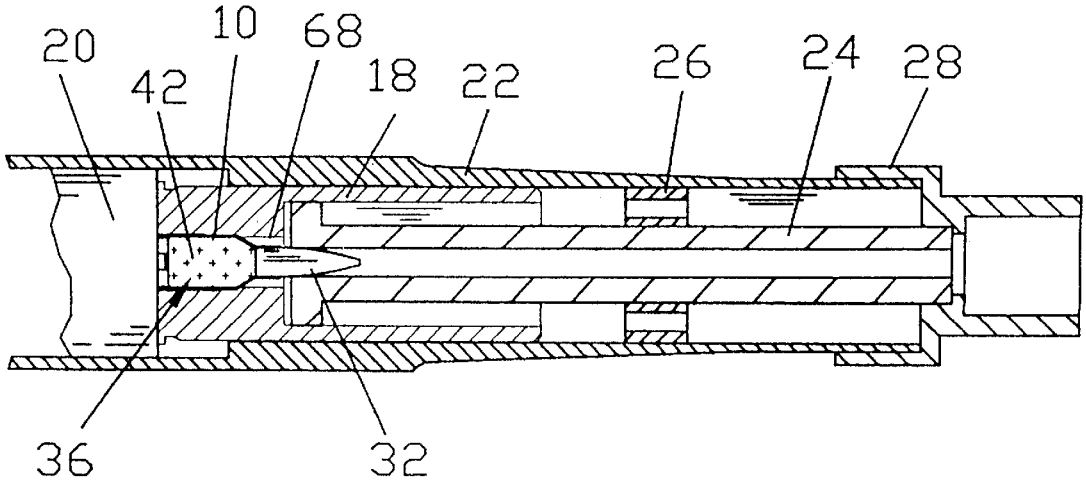
FIG. 3 is a plan view in section of the subcaliber cartridge case adaptor with a subcaliber cartridge loaded into the weapon.

Referring to FIG. 3 a cartridge case adaptor 18 with a subcaliber cartridge 36 has been placed in the weapon barrel 22. Weapon bolt 20 is in contact with the base of cartridge case adaptor 18 and with the base of the subcaliber cartridge 36. The front of projectile 32 has entered the rear of the bore of subcaliber barrel 24. Since the weapon is not locked, but is blowback operated, the mass of the weapon bolt 20 supports the cartridge case adaptor 18 with its subcaliber cartridge 36 in the weapon barrel 22.

Figure 4:
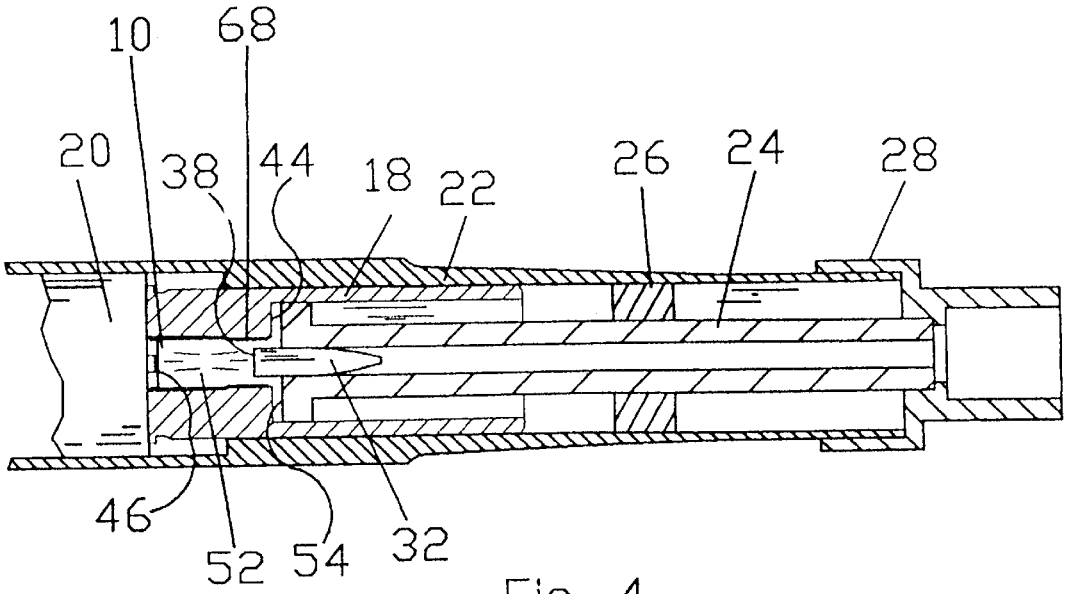
FIG. 4 is a plan view in section of the first embodiment during firing.

Referring to FIG. 4 the first embodiment of the subcaliber device of FIGS. 2 and 3 is in the act of firing. The burning propellant has generated pressurized gas 52 applying sufficient force to expand the unsupported neck of the cartridge case 10 against the enlarged chamber neck 68, releasing pressurized gas 52 past the base of subcaliber projectile 32 into the volume between primary booster 44 and primary booster area 54 of subcaliber barrel 24. Pressurized gas 52 also acts against the base 38 of subcaliber projectile 32 to provide shot start, projectile engraving and to drive the projectile through the bore of subcaliber barrel 24. The pressurized gas 52, acting equally in all directions also applies pressure against the projected area 46 equal to the area of the diameter of the inside of the neck of subcaliber cartridge case 10 at the enlarged chamber neck 68. The total force of the pressurized gas 52 acting through the cartridge case adaptor 18 against the weapon blot 20 is the sum of the force applied to the projected area 46 plus the force applied to the projected area 44 of the primary booster.

Figure 5:
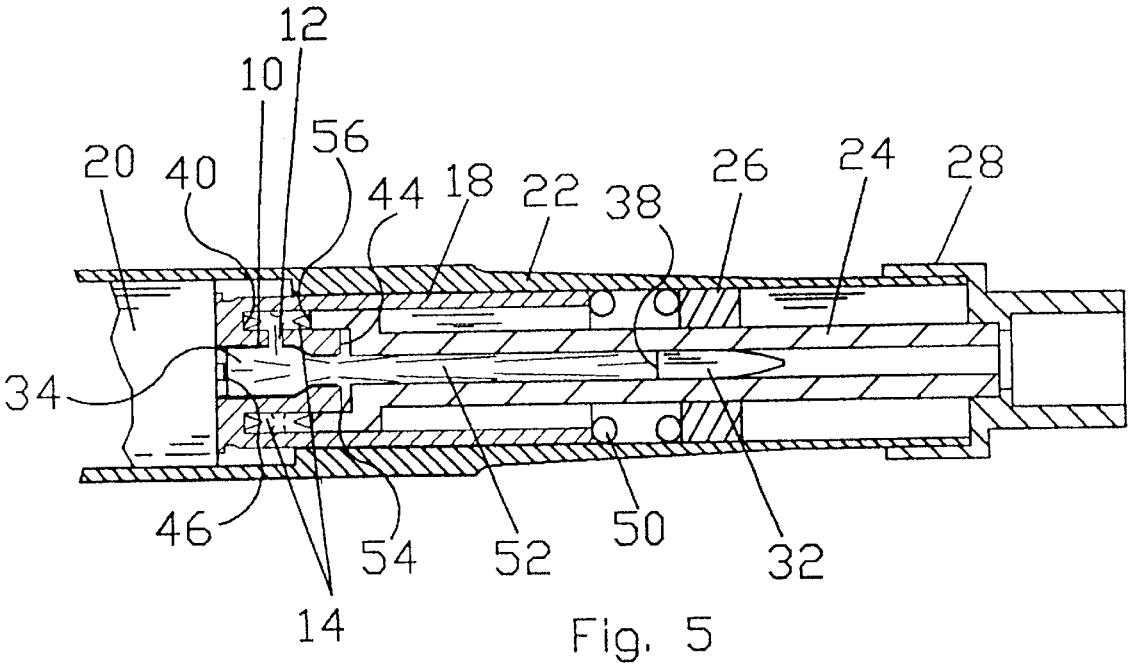
FIG. 5 is a plan view in section of a second embodiment during firing.

Referring to FIG. 5 as the second subcaliber device embodiment which provides power to the weapon bolt 20 for a longer period of time than the first embodiment for a given subcaliber cartridge. The burning propellant has generated pressurized gas 52 applying sufficient force against the base 38 of subcaliber projectile 32 to provide shot start, projectile engraving and to drive the projectile through the bore of subcaliber barrel 24. The pressurized gas 52, acting equally in all directions also applies pressure against the projected area 46 equal to the area of the base 38 of the subcaliber projectile 32. The pressurized gas 52 also acts against the primary booster area 54 of the subcaliber barrel 24, and against the projected primary booster area 44 of the cartridge case adaptor 18. A subcaliber chamber vent 12 is provided, connecting a subcaliber cartridge chamber 34 with a secondary booster chamber 14. The wall of the subcaliber cartridge case 10, at the subcaliber chamber vent 12, is not strong enough to contain the full pressure of the pressurized gas 52. The pressurized gas 52 causes the wall of the cartridge case 10 to fail at the subcaliber chamber vent 12, releasing pressurized gas into a secondary booster chamber 14 and pressurizing booster chamber 14 to apply pressure against projected area of secondary booster chamber 40. With the fast burning powder used, (such as Hercules Unique, Hercules Bullseye or Winchester-Western 296 ball powder) rupture of the subcaliber cartridge case wall takes place virtually at the moment of shot start of subcaliber projectile 32.

Making the subcaliber chamber vent 12 small results in temporarily trapping high pressure gas within the secondary booster chamber 14 after the projectile 32 has exited the muzzle of the subcaliber barrel 24. This corresponds to gas expansion type gas operated gun mechanisms. In other applications, making the subcaliber chamber vent 12 large causes the subcaliber cartridge case 10 to vent quickly into the secondary booster chamber 14 after firing, and to vent quickly back into the subcaliber cartridge chamber 34 upon muzzle exit of subcaliber projectile 32, corresponding to gas impingement type gas operated gun mechanisms. The total force of pressurized gas 52 acting through cartridge case adaptor 18 against weapon bolt 20 is the sum of the force applied to projected area of the subcaliber bore 46 plus the force applied to the projected area 44 of the primary booster plus the force applied to the projected area 40 of the secondary booster chamber 14.

A rebound spring 50 can be provided to assist in arresting the weapon bolt 20 as weapon bolt 20 goes into battery, compressing the rebound spring 50 and storing some of the energy of counter-recoiling weapon bolt 20. The potential energy stored in rebound spring 50 is later given back to boost recoil of weapon bolt 20 at the time of firing.

Figure 6:
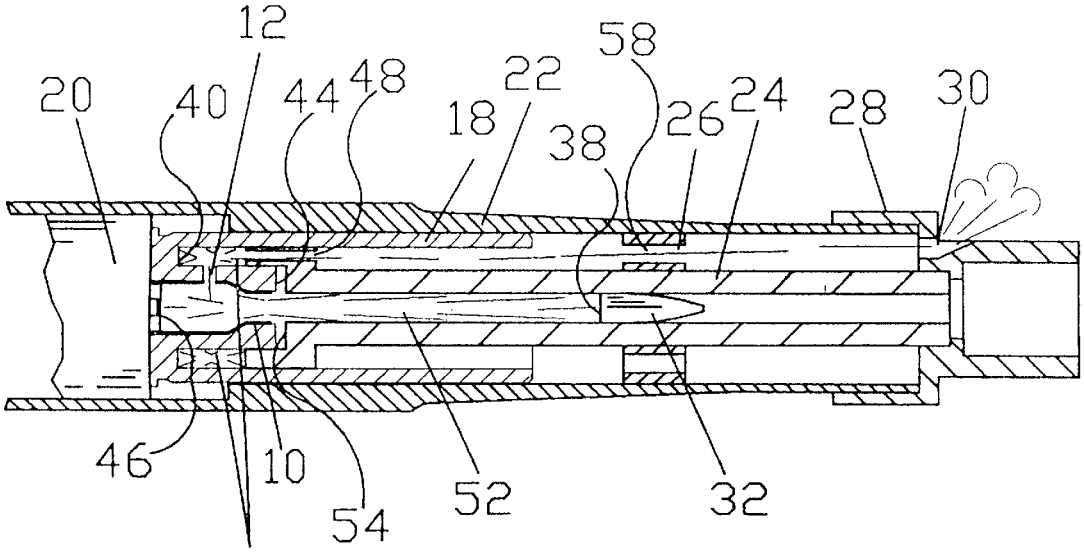
FIG. 6 is a plan view in section of a third embodiment during firing.

Referring to FIG. 6 as the third subcaliber device embodiment which provides for venting excess gas if a standard rifle or machine gun cartridge is used in the design. The burning propellant has generated pressurized gas 52 applying sufficient force against the base 38 of subcaliber projectile 32 to provide shot start, projectile engraving and to drive subcaliber projectile 32 through the bore of subcaliber barrel 24. The pressurized gas 52, acting equally in all directions also applies pressure against the projected area 46 of subcaliber projectile base 38. The pressurized gas 52 also acts against primary booster area 54 of subcaliber barrel 24, and against the projected primary booster area 44 of the cartridge case adaptor 18. A subcaliber chamber vent 12 is provided which connects the subcaliber cartridge chamber with the secondary chamber 14 which is vents through a booster vent 48 and thence through muzzle cap vent 30 in muzzle cap 28.

The total force of the pressurized gas 52 acting through the base of subcaliber cartridge case 10 and cartridge case adaptor 18 against weapon bolt 20 is the sum of the force applied to the projected area of the subcaliber bore 46 plus the force applied to the projected area 44 of the primary booster. There is negligible force applied to the projected area 40 of the secondary booster chamber 14 because the pressurized gas 52 is released from secondary booster chamber 14 through secondary booster vent 48, centering ring vent 58 and muzzle cap vent 30.

Figure 7:
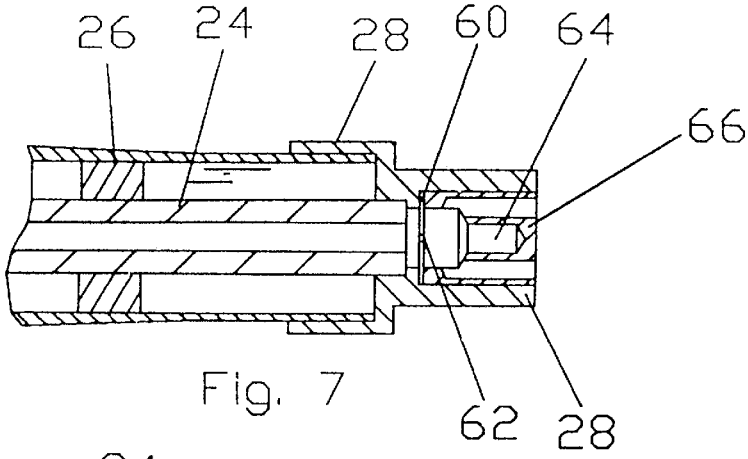
FIG. 7 is a partial plan view in section of a fourth embodiment showing how any of the other embodiments are converted into a blank firing adaptor.

Referring to FIG. 7 which shows the subcaliber device adapted to serve as a blank firing adaptor. A vented restrictor disc 60 has been place into the front of muzzle cap 28. The restrictor disc 60 is retained by a vented muzzle plug 66 which is secured to muzzle cap 28. Vented restrictor disc 60 is provided with a vent hole 62. Upon firing of a blank cartridge in the chamber, not shown, pressurized gas will fill the bore of subcaliber barrel 24. The pressurized gas will apply sufficient force to the cartridge case adaptor, not shown, to power the weapon. The vent hole 62 of vented restrictor disc 60 is sized to retain enough pressurized gas to operate the weapon and to release the remaining gas to make noise to simulate muzzle blast.

The vented muzzle plug 66 is provided with a bullet trap 64 sufficient to arrest the projectile if a bulleted cartridge is accidentally fired.

Figure 8:
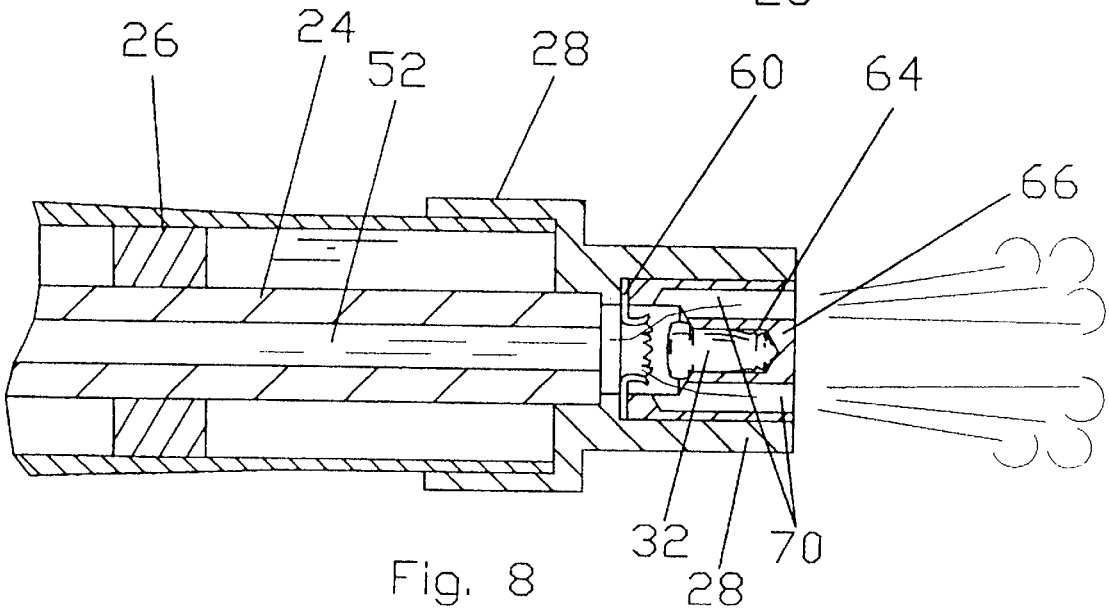
FIG. 8 is like FIG. 7, but where a bulleted cartridge has accidentally fired.

Referring to FIG. 8 which is like FIG. 7, but where a bulleted cartridge has accidentally been fired. The projectile 32 has perforated vented rupture disc 60. Projectile 32 has been arrested in bullet trap 64 of vented muzzle plug 66. The pressurized gas 52 is passing through the large hole created in the vented restrictor disc 60 by projectile 32. The pressurized gas 52 is vented to the atmosphere through muzzle plug vents 70 in vented muzzle plug 66.

NOMENCLATURE LIST

10 Subcaliber cartridge case
12 Subcaliber chamber vent
14 Secondary booster chamber
16 primer
18 cartridge case adaptor
20 weapon bolt
22 weapon barrel
24 subcaliber barrel
26 centering ring
28 muzzle cap
30 muzzle cap vent
32 subcaliber projectile
34 subcaliber cartridge chamber
36 subcaliber cartridge
38 base of subcaliber projectile
40 projected area of secondary booster chamber
42 propellant
44 primary booster
46 projected area of subcaliber bore
48 secondary booster vent
50 rebound spring
52 pressurized gas
54 primary booster area of subcaliber barrel
56 secondary booster area of subcaliber barrel
58 centering ring vent
60 vented restrictor disc
62 hole in vented restrictor disc
64 bullet trap
66 vented muzzle plug
68 enlarged subcaliber chamber neck
70 muzzle plug vent

What is claimed is:

1. A blank firing adaptor for a gun having a barrel with a front end and a back end, and a bolt for moving cartridges into position for firing, said adaptor comprising: a muzzle cap mounted on the front end of the barrel, said muzzle cap having a subcaliber barrel attached thereto, said subcaliber barrel extending centrally within the barrel, said muzzle cap further including a bullet trap defining a bullet trapping chamber extending centrally forward from said barrel, said bullet trap retaining a rupturable member closing the front of the barrel.

2. The blank firing adaptor of claim 1, further comprising a vent in said muzzle cap for venting gas from the barrel upon firing of a cartridge.

3. The blank firing adaptor of claim 2, further comprising a centering ring positioned between the barrel of the gun and said subcaliber barrel.

4. The blank firing adaptor of claim 3, wherein said centering ring defines a centering ring vent for allowing gas to pass through said centering ring between the barrel and said subcaliber barrel.

5. The blank firing adaptor of claim 1, wherein said rupturable member includes a vent.

6. The blank firing adaptor of claim 5, wherein said vent includes a vent hole defined by said rupturable member.

7. The blank firing adaptor of claim 6, wherein said muzzle cap defines at least one muzzle plug vent in communication with said vent hole.

8. The blank firing adaptor of claim 7, further comprising a centering ring positioned between the barrel of the gun and said subcaliber barrel.

9. The blank firing adaptor of claim 1, wherein said rupturable member is constructed to rupture upon firing of a cartridge that produces a gas pressure in the barrel exceeding a predetermined threshold.

10. The blank firing adaptor of claim 1, wherein said muzzle cap is threadedly mounted on the front end of the barrel.

11. The blank firing adaptor of claim 1, wherein said rupturable member is a disc.

* * * * *

UNITED STATES PATENT AND TRADEMARK OFFICE

CERTIFICATE OF CORRECTION

PATENT NO. : 5,983,772
DATED : November 16, 1999
INVENTOR(S) : George L. Reynolds, S.Paul Reynolds, John M. Miller It is certified that error appears in the above-identified patent and that said Letters Patent is hereby corrected as shown below:

In column 3, line 28, please delete the word "blank" and insert --blanks--.

Signed and Sealed this

Ninth Day of January, 2001

*Attest:*

Q. TODD DICKINSON

*Attesting Officer*

*Commissioner of Patents and Trademarks*